United States Patent [19]

Triche

[11] Patent Number: 4,884,297

[45] Date of Patent: Dec. 5, 1989

[54] ARM PROTECTOR

[76] Inventor: Freddie J. Triche, 1537 Bernice St., Morgan City, La. 70380

[21] Appl. No.: 285,728

[22] Filed: Dec. 16, 1988

[51] Int. Cl.[4] ..... A41D 13/08

[52] U.S. Cl. ..... 2/16; 2/59; 2/268

[58] Field of Search ..... 2/2.5, 16, 21, 22, 24, 2/59, 268, 411, 243 A

[56] References Cited

U.S. PATENT DOCUMENTS

| | | | |
|---|---|---|---|
| 1,284,536 | 11/1918 | Yaeger | 2/59 |
| 1,851,011 | 3/1932 | Jensen | 2/16 |
| 2,059,136 | 10/1936 | Moller | 2/59 X |
| 2,446,654 | 8/1948 | Kremar | 2/24 |
| 4,011,596 | 3/1977 | Chang | 2/16 |
| 4,047,250 | 9/1977 | Norman | 2/16 X |
| 4,120,052 | 10/1978 | Butler | 2/24 X |
| 4,366,813 | 1/1983 | Nelson | 2/24 X |

FOREIGN PATENT DOCUMENTS

| | | | |
|---|---|---|---|
| 0158215 | 10/1985 | European Pat. Off. | 2/24 |
| 2600900 | 1/1988 | France | 2/24 |

*Primary Examiner*—Werner H. Schroeder
*Assistant Examiner*—Jeanette E. Chapman
*Attorney, Agent, or Firm*—Richard C. Litman

[57] ABSTRACT

A protective guard for the arm of a welder which includes both padding and insulation to cushion and protect the arm from heat in activities such as welding or similar tasks. The guard includes a pad and a flexible flap which is applied over the upper surface of the arm in order to more completely protect the arm above the area normally covered by the cuff of the standard welding glove. The guard may be easily applied by the use of elastic straps attached to the pad and the pad is sufficient length to extend past the elbow in order to prevent both the arm and elbow from coming into contact with heated objects, while the flexible flap is formed to allow complete bending of the arm without binding at the inside of the elbow. At least the outer portions of the guard are preferably formed of durable heat-resistant materials, such as leather.

7 Claims, 2 Drawing Sheets

FIG. 3
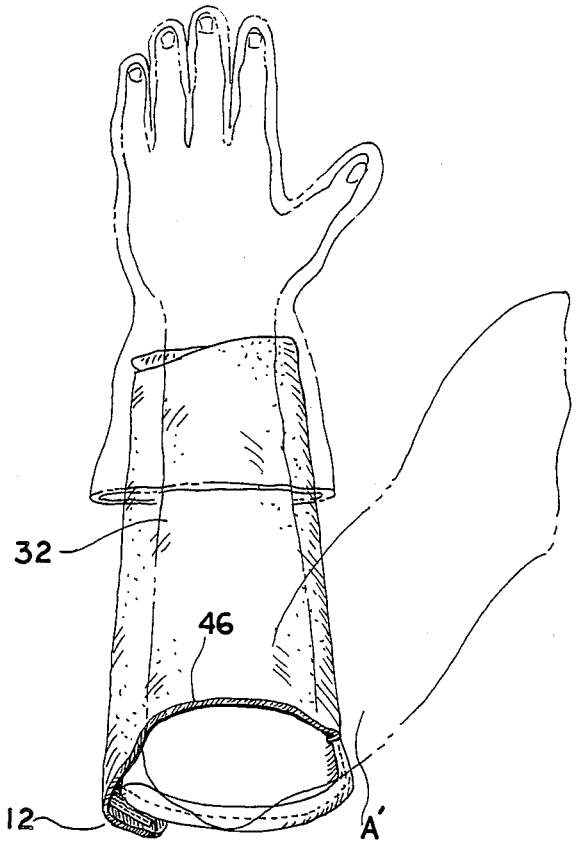
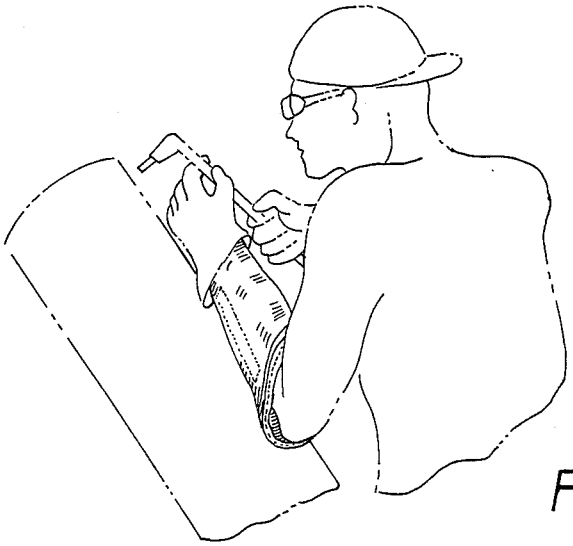
FIG. 4

ARM PROTECTOR

FIELD OF THE INVENTION

This invention relates to protective equipment used in welding, and more specifically to a device to protect the arm of a person engaged in welding.

BACKGROUND OF THE INVENTION

The welding trade encompasses many hazards, not the least of which is the possibility of at least minor burns. While protective garments have been developed for the face and hands in the form of masks and gloves, little has been done to protect the upper body extremities beyond those areas protected by the standard welding gloves and the like. The next step in protection is generally considered to be a leather apron, which has severe drawbacks regarding mobility and comfort for the welder.

However, none of this equipment provides sufficient protection for the arm of the welder, an area doubly vulnerable for those persons engaged in welding large objects such as heavy pipes, ships, armored vehicles and the like. When engaged in such welding, the upper surface of the arm is subject to burns from sparks or spattered molten metal, as with any other type of welding, but the opposite side of the arm also may come in contact with the hot metal surface which is being welded. Indeed, in order to provide a steadier position many welders will rest their arm on the surface of the object being welded, which in the case of large objects, will tend to conduct much of the heat away from the immediate area of the weld itself and into the surrounding metal. What is needed is a protective garment capable of covering not only the upper surface of the arm, but also providing insulation from the extreme heat generated in typical heavy welding operations in which the welder may rest his arm upon the object being welded.

DESCRIPTION OF THE RELATED ART

Various forms of welding gloves are known in the art. U.S. Pat. Nos. 3,374,487 and 4,445,232 issued respectively to Slimovitz and Nelson are typical examples. While these gloves provide excellent protection for the hand and wrist, no protection is provided for the arm, particularly near the elbow where a welder would be likely to rest his arm.

Other protective devices for the upper extremities are known, such as U.S. Pat. Nos. 4,099,269 and 4,190,902 issued to Porner and Rhee, respectively. These devices, however, are intended for the cushioning of impacts to the extremities rather than insulation, and as such tend to provide protection only for the limited area for which such protection is most likely needed. Due to the emphasis on impact protection the composition of such protectors is primarily of plastics, which of course would not tend to withstand the high temperatures associated with welding, without additional protection.

SUMMARY OF THE INVENTION

By the present invention, an improved article for the protection of the arm during welding operations is disclosed.

Accordingly, it is an object of the present invention to provide an article for the protection of the arm that is also capable of providing protection from burns above the area covered by the standard welding glove.

It is another object of the present invention to provide a protective article which may serve as an insulating and cushioning pad for the arm.

It is an additional object of the present invention to provide a protective article of durable construction.

It is a further object of the present invention to provide a protective article which may be easily applied and removed.

It is yet another object of the present invention to provide a protective article which is composed of fire-resistant or fireproof materials.

With these and other objects in view which will more readily appear as the nature of the invention it is better understood, the invention consists in the novel combination and arrangement of parts hereinafter more fully described, illustrated and claimed with reference being made to the attached drawings.

BRIEF DESCRIPTION OF THE DRAWINGS

FIG. 3 is a top view of the protector in its closed position on a user's arm; and FIG. 4 is a view of the protector of FIG. 1 on a user's arm during a welding operation.

Similar reference characters designate corresponding parts throughout the several figures of the drawings.

DESCRIPTION OF THE PREFERRED EMBODIMENT

Figure 1:
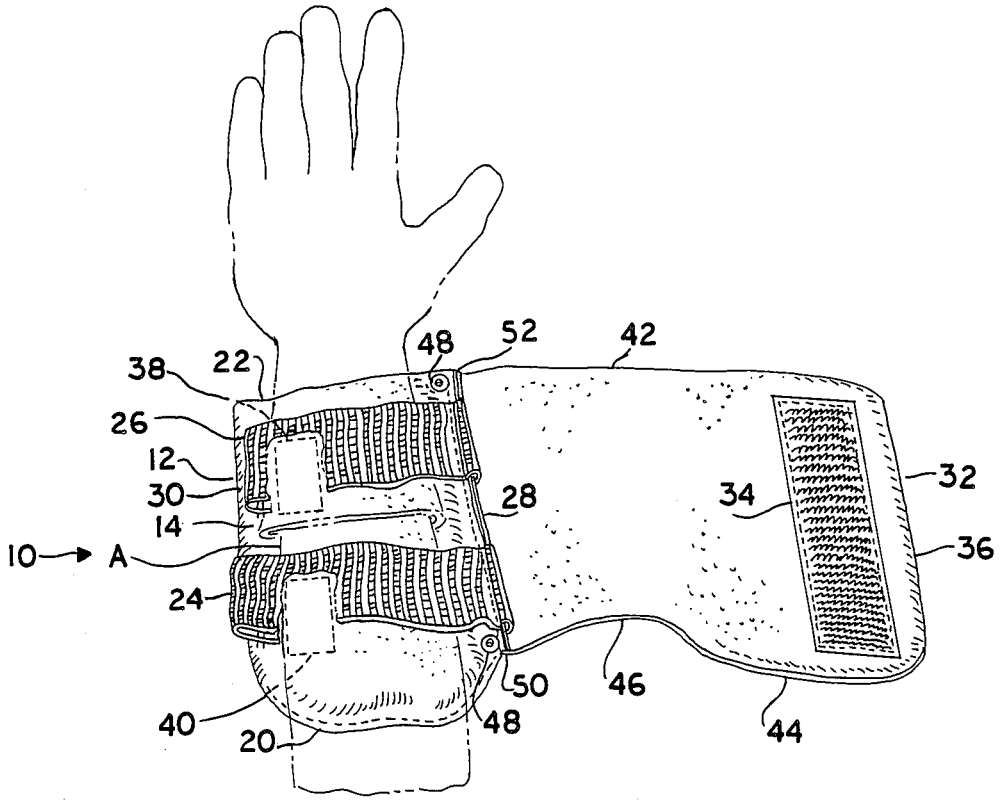
FIG. 1 is a top view of the protector in its open position, disclosing the method by which it is worn.

Referring now to the drawings, the present invention will be understood to relate to an arm protector for use by a welder during welding operations or similar activities where such protection may be required, which is designated generally by the numeral 10. The protector 10 is displayed in its open condition in FIG. 1 on a user's arm. The protector 10 includes a pad 12 having an upper surface 14 and a lower surface 16 with side edges 28, 30, and formed of insulating and cushioning material 18 such as plastic foam covered with fire-resistant material as clearly shown in the broken away portion of FIG. 2.

Figure 2:
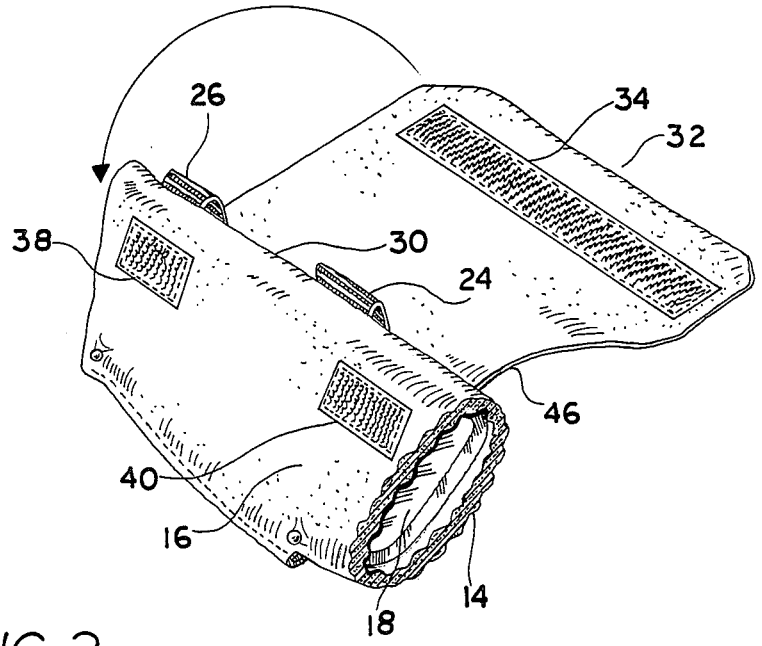
FIG. 2 is a perspective view partially broken away of the protector of FIG. 1 from below, disclosing the attachment and securing means.

The pad 12 shown partially broken away in FIG. 2 completely encloses insulating and cushioning material 18 within the material forming upper and lower surfaces 14 and 16, which surfaces 14 and 16 are bounded by side edges 28 and 30, front end 22, and rear end portion 20. In FIG. 2, the rear end portion 20 has been eliminated in order to more clearly show the insulating and cushioning material 18 which would not be visible or accessible in the standard construction of protector 10. The arm A of a user is inserted over upper suface 14 of pad 12, between straps 24 and 26 and upper surface 14, more clearly shown in FIG. 1.

The protector 10 also includes a laterally extending flap 32 attached by sewing or the like to the side edge 28 of the pad 12. The flap 32 includes front and rear edges 42,44 and an outer edge 36. Upper and lower surfaces 14 and 16, as well as the flap 32, are preferably formed of leather for durability and proper insulating properties. Obviously other suitable materials may be used. Preferably, the pad 12 includes a rear end portion 20 extending slightly past the rear edge 44 of the flap 32 and tapered rearwardly somewhat so that in the worn position, the pad 12 extends under the elbow of the user as shown best in FIG. 4.

The upper surface 14 of the pad 12 is provided with straps 24 and 26 of elastic material, extending between edges 28,30 and suitably secured to the pad 12 in longitudinally spaced relationship as shown best in FIG. 1. As can be seen, the straps 24,26 are adapted to receive the arm of the user to retain the pad 12 in underlying relationship with the arm, designated by the letter A, as shown in FIGS. 1 and 4. It will be noted that a welder's glove, designated generally by the letter G in FIG. 4, is worn in conjunction with the protector 10.

When the arm A has been positioned within the straps 24,26, the flap 32 may then be wrapped over the upper surface of the arm to protect the arm A of a person using the protector 10, as shown in FIG. 3. Means are provided for releasably securing the flap 12 in the wrapped position of FIG. 3. More specifically, VELCRO is used for this purpose by providing a VELCRO patch 34 on the flap 32 with complementary patches of VELCRO 38,40 on the lower surface 16 of the pad 12. Other securing means, such as male and female snap fasteners, may also be used. Thus, when the flap 32 is wrapped over the arm A in the direction of the arrow F of FIG. 2 the patch 34 grips the patches 38,40, holding the flap in the overlying position for use.

In the preferred embodiment, a heat-resistant and/or fireproof thread or cord is used in the construction of the protector 10. Similarly, such threads may be used to secure the VELCRO patches 34,38,40 to the various parts of the protector 10, and further reinforcement may be added by means of rivets 48 or other mechanical fasteners at points of highest stress on the device, such as at corners 50 and 52.

In use, the protector 10 is applied as shown in FIG. 1 and 2. The arm A may be inserted between straps 24 and 26 and pad 12, orienting the arm so that the outside of the arm is engaged by straps 24,26 and the inside of the arm rests on the upper surface 14 of pad 12. The arm A is preferably positioned so that the pad end portion 20 is located beneath the elbow of the user, thereby providing a proper and comfortable fit. The flap 32 is then folded over the arm A and straps 24,26 and secured with the VELCRO patches 34,38,40 as explained above. It will be noted that the flap 32 is provided with a cutout 46, thereby providing clearance for the upper arm when the arm is flexed, and allowing freedom of movement for the user's arm during a welding operation. As can be seen, after the protector 10 is positioned for use, the glove G may be positioned on the user's arm.

In the worn position of FIG. 4, the protector 10 provides protection for the arm when welding. When engaged in welding large masses of metal such as large pipes, etc. the necessarily large welding tip (for gas welding) or amperage (for arc welding) tends to produce large amounts of heat, which is necessary in order to allow for the large amount of heat loss from the immediate area of the weld into the surrounding mass of metal. A welder will often desire to provide a more stable grip by using is free hand to help steady the welding torch or rod and bracing the arm against the surface of the object being welded. Pad 12 provides the necessary insulation and protection to allow such a technique. Moreover, flap 32, which is placed over the otherwise exposed area of the arm A, provides further protection from sparks or spatters of molten metal for the portion of the arm A which might otherwise be exposed above the cuff of any welding glove which may be worn.

As the average person is right-handed, the protector 10 as shown in the drawings is shown to more properly and closely fit the left arm of the person using the protector. Obviously the protector may be applied to either arm, and such a device may be produced in an embodiment which is a "mirror image" of that shown in the drawings so as to fit the right arm of the user.

It is to be understood that the present invention is not limited to the sole embodiment described above, but encompasses any and all embodiments within the scope of the following claims.

What is claimed is:

1. An arm protector for use in the welding trade or the like comprising, in combination;

an elongated pad insulating material having a top surface and and bottom surface, means on said pad top surface for detachably mounting said pad on the arm of a user with said pad in underlying relationship therewith, a laterally extending flap of insulating material attached to said pad, and means for releasably securing said flap to said pad in overlying relationship with said pad and with the user's arm sandwiched therebetween whereby said arm is fully protected from heated surfaces and the like.

2. A protector in accordance with claim 1 wherein said pad is formed of an insulating and fire-resistant material.

3. A protector in accordance with claim 1 wherein said releasably securing means comprises an element of VELCRO material on said flap and an element of corresponding VELCRO material on said pad bottom surface.

4. A protector in accordance with claim 2 wherein said pad includes an interior layer of cushioning material.

5. A protector in accordance with claim 1 wherein said detachably mounting means comprises at least one transversely extending strap of elastic material on said pad top surface.

6. A protector in accordance with claim 1 wherein said pad has a length for extending in underlying relationship with both the wrist and the elbow of the user's arm.

7. A protector in accordance with claim 6 wherein said pad is provided with an end portion extending rearwardly beyond said flap and underlying the elbow of a user's arm in the worn position to thereby permit bending of the arm without interference.

* * * * *